US006951312B2

(12) United States Patent
Casalmir et al.

(10) Patent No.: US 6,951,312 B2
(45) Date of Patent: Oct. 4, 2005

(54) PARTICLE ENTRAINING EDUCTOR-SPIKE NOZZLE DEVICE FOR A FLUIDIZED BED JET MILL

(75) Inventors: D. Paul Casalmir, Sodus, NY (US); Samir Kumar, Penfield, NY (US); Fumii Higuchi, Mississauga (CA)

(73) Assignee: Xerox Corporation, Stamford, CT (US)

( * ) Notice: Subject to any disclaimer, the term of this patent is extended or adjusted under 35 U.S.C. 154(b) by 168 days.

(21) Appl. No.: 10/368,338

(22) Filed: Feb. 18, 2003

(65) Prior Publication Data

US 2004/0016835 A1 Jan. 29, 2004

Related U.S. Application Data

(60) Provisional application No. 60/398,354, filed on Jul. 23, 2002.

(51) Int. Cl.[7] ..... B02B 1/00; B02B 5/02; B02C 11/08; B02C 21/00; B02C 23/18

(52) U.S. Cl. ..... 241/39; 241/5; 241/38; 241/40; 241/41

(58) Field of Search ..... 241/39, 40, 5, 241/38, 41

(56) References Cited

U.S. PATENT DOCUMENTS 238,044 A * 2/1881 Luckenbach ..... 241/5
3,565,348 A 2/1971 Dickerson et al. ..... 241/5
4,059,231 A 11/1977 Neu ..... 241/5
4,089,472 A 5/1978 Siegel et al. ..... 241/5
4,186,772 A * 2/1980 Handleman ..... 241/5
5,423,490 A 6/1995 Zampini ..... 241/5
5,683,039 A * 11/1997 Leute et al. ..... 241/5
5,732,893 A * 3/1998 Nied ..... 241/39

* cited by examiner

*Primary Examiner*—Derris H Banks
*Assistant Examiner*—Jason Y Pahng
(74) *Attorney, Agent, or Firm*—Tallam J. Nguti

(57) ABSTRACT

An eductor-spike nozzle device includes (a) a first cylindrical member having a first wall including a cowl lip and defining a first hollow interior, and (b) a second cylindrical member mounted within the first hollow interior and having a second wall (i) externally defining an annular flow path with the first wall for flow of a first stream of fluid, and fluid compressing throat region with the cowl lip for creating a high velocity stream, and (ii) internally defining a second hollow interior for flow of a second stream of fluid so as to form the composite stream of high velocity fluid with the first stream of fluid, thereby increasing a probability of the composite stream receiving and entraining particles introduced into the composite stream.

13 Claims, 7 Drawing Sheets

PARTICLE ENTRAINING EDUCTOR-SPIKE NOZZLE DEVICE FOR A FLUIDIZED BED JET MILL

CROSS REFERENCE TO ISSUED PATENTS

This application is based on a Provisional Patent Application No. 60/398,354, filed Jul. 23, 2002.

Attention is directed to commonly owned and assigned U.S. Pat. No. 5,133,504 issued Jul. 28, 1992, entitled THROUGHPUT EFFICIENCY ENHANCEMENT OF FLUIDIZED BED JET MILL, and U.S. Pat. No. 5,683,039 issued Nov. 4, 1997, entitled LAVAL NOZZLE WITH CENTRAL FEED TUBE AND PARTICLE COOMINUTION PROCESS THEREOF.

The disclosures of the above mentioned patents are incorporated herein by reference in their entireties.

RELATED APPLICATIONS

This application is related to U.S. application Ser. No. 10/368,336 entitled "PLURAL ODD NUMBER BELL-LIKE OPENINGS NOZZLE DEVICE FOR A FLUIDIZED BED JET MILL" filed on the same date herewith, and having at least one common inventor.

BACKGROUND OF THE INVENTION

Fluid energy, or jet, mills are size reduction machines in which particles to be ground (feed particles) are accelerated in a stream or jet of gas such as compressed air or steam, and ground in a grinding chamber by their impact against each other or against a stationary surface in the grinding chamber. Different types of fluid energy mills can be categorized by their particular mode of operation. Mills may be distinguished by the location of feed particles with respect to incoming air. In the commercially available Majac jet pulverizer, produced by Majac Inc., particles are mixed with the incoming gas before introduction into the grinding chamber. In the Majac mill, two stream or jets of mixed particles and gas are directed against each other within the grinding chamber to cause fracture of the particles. An alternative to the Majac mill configuration is to accelerate within the grinding chamber particles that are introduced from another source. An example of the latter is disclosed in U.S. Pat. No. 3,565,348 to Dickerson, et al., which shows a mill with an annular grinding chamber into which numerous gas jets inject pressurized air tangentially.

During grinding, particles that have reached the desired size must be extracted while the remaining, coarser particles continue to be ground. Therefore, mills can also be distinguished by the method used to classify the particles. This classification process can be accomplished by the circulation of the gas and particle mixture in the grinding chamber. For example, in "pancake" mills, the gas is introduced around the periphery of a cylindrical grinding chamber, short in height relative to its diameter, inducing a vorticular flow within the chamber. Coarser particles tend to the periphery, where they are ground further, while finer particles migrate to the center of the chamber where they are drawn off into a collector outlet located within, or in proximity to, the grinding chamber. Classification can also be accomplished by a separate classifier.

Typically, this classifier is mechanical and features a rotating, vaned, cylindrical rotor. The air flow from the grinding chamber can only force particles below a certain size through the rotor against the centrifugal forces imposed by the rotation of the rotor. The size of the particles passed varies with the speed of the rotor; the faster the rotor, the smaller the particles. These particles become the mill product. Oversized particles are returned to the grinding chamber, typically by gravity.

Yet another type of fluid energy mill is the fluidized bed jet mill in which a plurality of gas jets are mounted at the periphery of the grinding chamber and directed to a single point on the axis of the chamber. This apparatus fluidizes and circulates a bed of feed material that is continually introduced either from the top or bottom of the chamber. A grinding region is formed within the fluidized bed around the intersection of the gas jet flows; the particles impinge against each other and are fragmented within this region. A mechanical classifier is mounted at the top of the grinding chamber between the top of the fluidized bed and the entrance to the collector outlet.

The primary operating cost of jet mills is for the power used to drive the compressors that supply the pressurized gas. The efficiency with which a mill grinds a specified material to a certain size can be expressed in terms of the throughput of the mill in mass of finished material for a fixed amount of power produced by the expanding gas. One mechanism proposed for enhancing grinding efficiency is the projection of particles against a plurality of fixed, planar surfaces, fracturing the particles upon impact with the surfaces.

An example of this approach is disclosed in U.S. Pat. No. 4,059,231 to Neu, in which a plurality of impact bars with rectangular cross sections are disposed in parallel rows within a duct, perpendicular to the direction of flow through the duct. The particles entrained in the air stream or jet passing through the duct are fractured as they strike the impact bars. U.S. Pat. No. 4,089,472 to Siegel, et al. discloses an impact target formed of a plurality of planar impact plates of graduated sizes connected in spaced relation with central apertures through which a particle stream or jet can flow to reach successive plates. The impact target is interposed between two opposing fluid particle stream or jets, such as in the grinding chamber of a Majac mill.

Although fluidized jet mills can be used to grind a variety of particles, they are particularly suited for grinding other materials, such as toners, used in electrostatographic reproducing processes. These toner materials can be used to form either two component developers, typically with a coarser powder of coated magnetic carrier material to provide charging and transport for the toner, or single component developers, in which the toner itself has sufficient magnetic and charging properties that carrier particles are not required.

The toners are typically melt compounded into sheets or pellets and processed in a hammer mill to a mean particle size of between about 400 to 800 microns. They are then ground in the fluid energy mill such as a fluidized bed jet mill or grinder to a mean particle size of between 3 and 30 microns. Such toners have a relatively low density, with a specific gravity of approximately 1.7 for single component and 1.1 for two component toner. They also have a low glass transition temperature, typically less than 70° C. The toner particles will tend to deform and agglomerate if the temperature of the grinding chamber exceeds the glass transition temperature.

In the fluidized bed jet mill or grinder, high velocity fluid, such as air is introduced through 3 to 5 air nozzle devices or nozzles located at the periphery of the grinding chamber and centrally focused. The high velocity air flow from these nozzles accelerates the material towards the center of the mill. Size reduction is accomplished through the ensuing particle to particle collisions. This method of size reduction has been found to be most effective for size reduction of low-melt compounds typically found in current toner formulations.

In such toner production, size reduction is typically the rate limiting unit operation as well as having the highest process contribution to the manufacturing cost. Much effort has been concentrated on studying and understanding the size reduction process in order to increase its efficiency and thus maximize throughput rate at minimum cost.

Two factors, the probability of particle to particle collisions and the kinetic energy of these particles during such collisions are understood to affect the efficiency of the size reduction process.

Unfortunately however, fluidized bed jet mills or grinders which are used for such grinding or size reduction of toner particles, have an extremely low energy utilization efficiency. For example, it has been estimated that only 5% of total energy used up by a size reducing fluidized bed jet mill is actually utilized in particle size reduction. Such a low energy utilization efficiency is an opportunity for mill and/or nozzle designs to increase the energy efficiency of the process, thus resulting in significant operating cost savings.

Conventionally, several approaches, including nozzle redesigns have been tried, and continue to be tested for improving grinding energy utilization efficiency and throughput rate of such fluidized bed jet mills or grinders. Improved nozzle designs are directed towards increasing the probability of particle to particle collisions and towards increasing the kinetic energy of particle impacts.

A first type of conventional nozzle consists of a nozzle device having a single converging-diverging opening or nozzle that discharges a single jet stream or jet of fluid and has a converging-diverging profile. The nozzle profile includes a converging region, a throat region, and a straight diverging flare region from the throat region to the discharge end.

Another type of conventional nozzle design as disclosed for example in U.S. Pat. No. 5,423,490 consists of a nozzle device having 4 small converging-diverging openings or nozzles that each can discharge a small jet of fluid, for a total of four such jets. The four jets together then form a single composite jet downstream or jet from the discharge end of the nozzle device. Thus this nozzle works on the concept of subdividing the main nozzle into 4 smaller focused nozzles that provide the opportunity to entrain more material into the jet. As such, it is claimed that relative to the single converging-diverging opening discharged jet stream or jet nozzle device, this latter design allows for increased entrainment of particles of material being introduced into the individual fluid jets as they are being discharged from the 4 converging-diverging nozzles or openings.

SUMMARY OF THE DISCLOSURE

In accordance with the present disclosure, there is provided an eductor-spike nozzle device for mounting through side walls of a fluidized bed jet mill to discharge a composite stream of high velocity fluid for receiving, entraining and delivering particles of material into a grinding chamber of a fluidized bed jet mill for particle to particle collisions. The eductor-spike nozzle device includes (a) a first cylindrical member having a first wall including a cowl lip and defining a first hollow interior, and (b) a second cylindrical member mounted within the first hollow interior and having a second wall (i) externally defining an annular flow path with the first wall for flow of a first stream of fluid, and fluid compressing throat region with the cowl lip for creating a high velocity stream, and (ii) internally defining a second hollow interior for flow of a second stream of fluid so as to form the composite stream of high velocity fluid with the first stream of fluid, thereby increasing a probability of the composite stream receiving and entraining particles introduced into the composite stream.

BRIEF DESCRIPTION OF THE DRAWINGS

In the detailed description of the disclosure below, reference is made to the drawings, in which.

DETAILED DESCRIPTION OF THE DISCLOSURE

Figure 1:
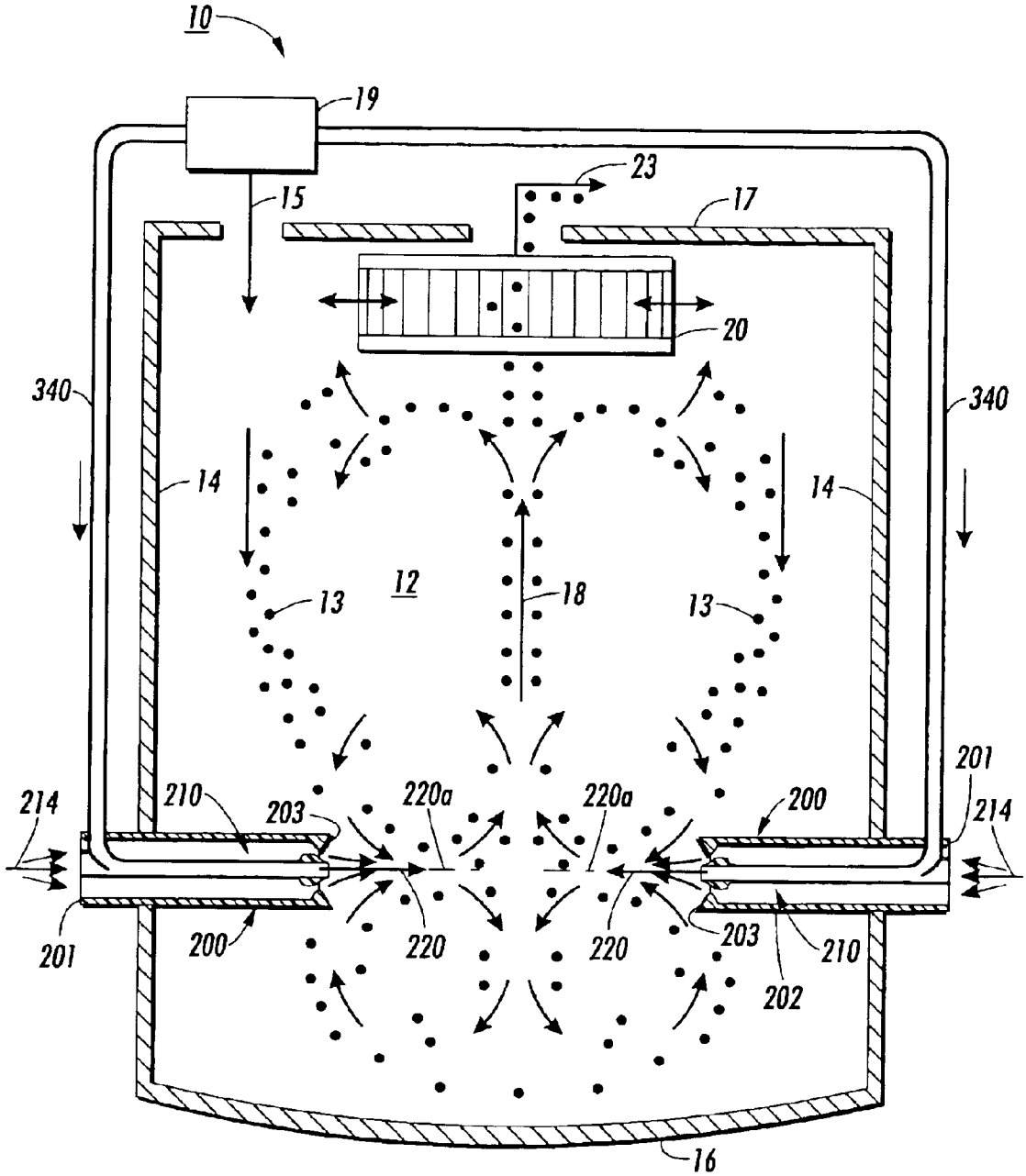
FIG. 1 is a schematic representation in cross section, and in elevation of a fluidized bed jet mill having the particle entraining eductor-spike nozzle device of the present invention.

While the present invention will be described in connection with a preferred embodiment thereof, it will be understood that it is not intended to limit the invention to this embodiments. On the contrary, it is intended to cover all alternatives, modifications, and equivalents as may be included within the spirit and scope of the invention as defined by the appended claims.

Referring in general to all the FIGS. 1–12, it can be seen that a fluidized bed jet mill 10 has been provided for grinding particles 13 of material fed from a source 19 via a primary feed 15. The fluidized bed jet mill 10 includes (a) a base 16, a top 17 and side walls 14 defining a grinding chamber 12 having a central axis 18; and (b) plural eductor-spike nozzle devices 200 mounted through the side walls into the grinding chamber for each discharging a high velocity composite stream or jet 220 of fluid 214 towards the central axis 18 of the grinding chamber, and delivering for collision at such central axis, entrained particles 13 of material to be ground.

Referring specifically now to FIG. 1, the fluidized bed jet mill 10 comprises the grinding chamber 12 having the peripheral walls 14, the base 16, top 17, the central axis 18, and the plurality of sources 200 of particle entraining high velocity composite fluid stream or jet 220. Each source of the plurality of sources 200 as shown is mounted through the peripheral or side walls 14 and extends into the grinding chamber 12 so that they are arrayed symmetrically about the central axis 18. Additionally, the sources or nozzles 200 are oriented for each directing the stream or jet 220 of the high velocity fluid along an axis that is coincident with the longitudinal axis of the eductor-spike nozzle device 200. As mounted into the chamber 12, the longitudinal axis of each nozzle device 200 is substantially perpendicular to, as well as intersects the central axis 18 of the grinding chamber 12. The central axis 18 as such is thus situated at and may comprise the point of intersection of the fluid stream or jets 220, and hence the point of particle to particle collisions and breakage.

The fluidized jet mill 10 includes a source 19 of particles 13 of material to be ground. The particles 13 are introduced from the source 19 into the grinding chamber 12 via a primary feed 15, and via secondary feed conduits 340 into the eductor portion 302 of each of the eductor-spike nozzle devices 200 (FIGS. 1, and 4–6)

As further illustrated, the fluidized jet mill 10 also includes a particle classifying and discharging device 20 mounted towards the top 17 of the mill. In operation, the mill 10 fluidizes and circulates particles 13 of material that are continually introduced by the feeds 15, 340. The particle breakage or grinding region is located around the intersection of the composite streams 220 where the entrained particles impinge against each other and are fragmented. Larger particles tend to fall back or are rejected by the classifier 20, and are thus returned for entrainment by the composite streams 220. Meanwhile, particles that have been broken to an acceptable small size are pulled in by the classifying device 20 for transfer to a particle collector outlet 23.

Figure 2:
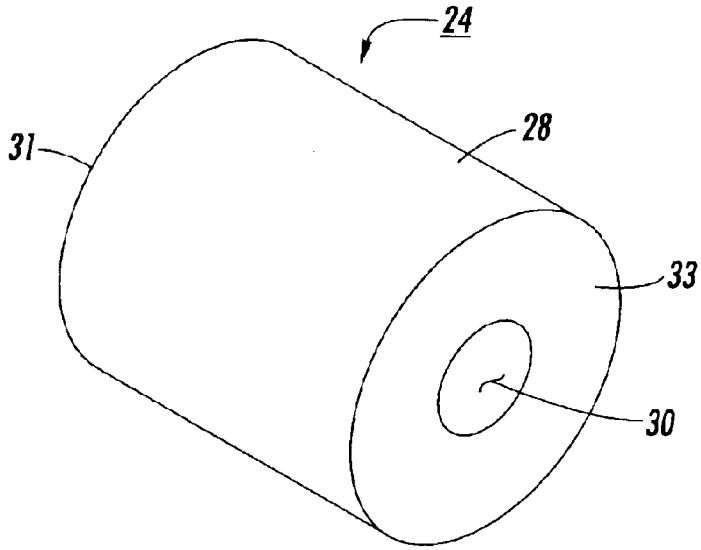
FIG. 2 (PRIOR ART)
FIG. 2 is a perspective schematic of a conventional nozzle device having a single converging-diverging profile nozzle opening.
Figure 3:
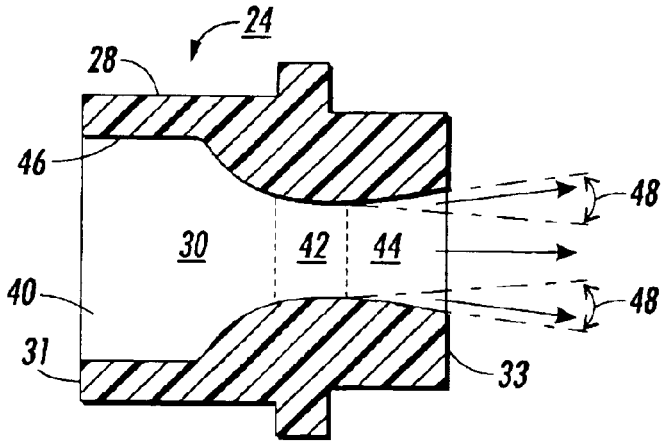
FIG. 3 (PRIOR ART)
FIG. 3 is a cross-sectional view of the conventional nozzle device of FIG. 2.
Figure 7:
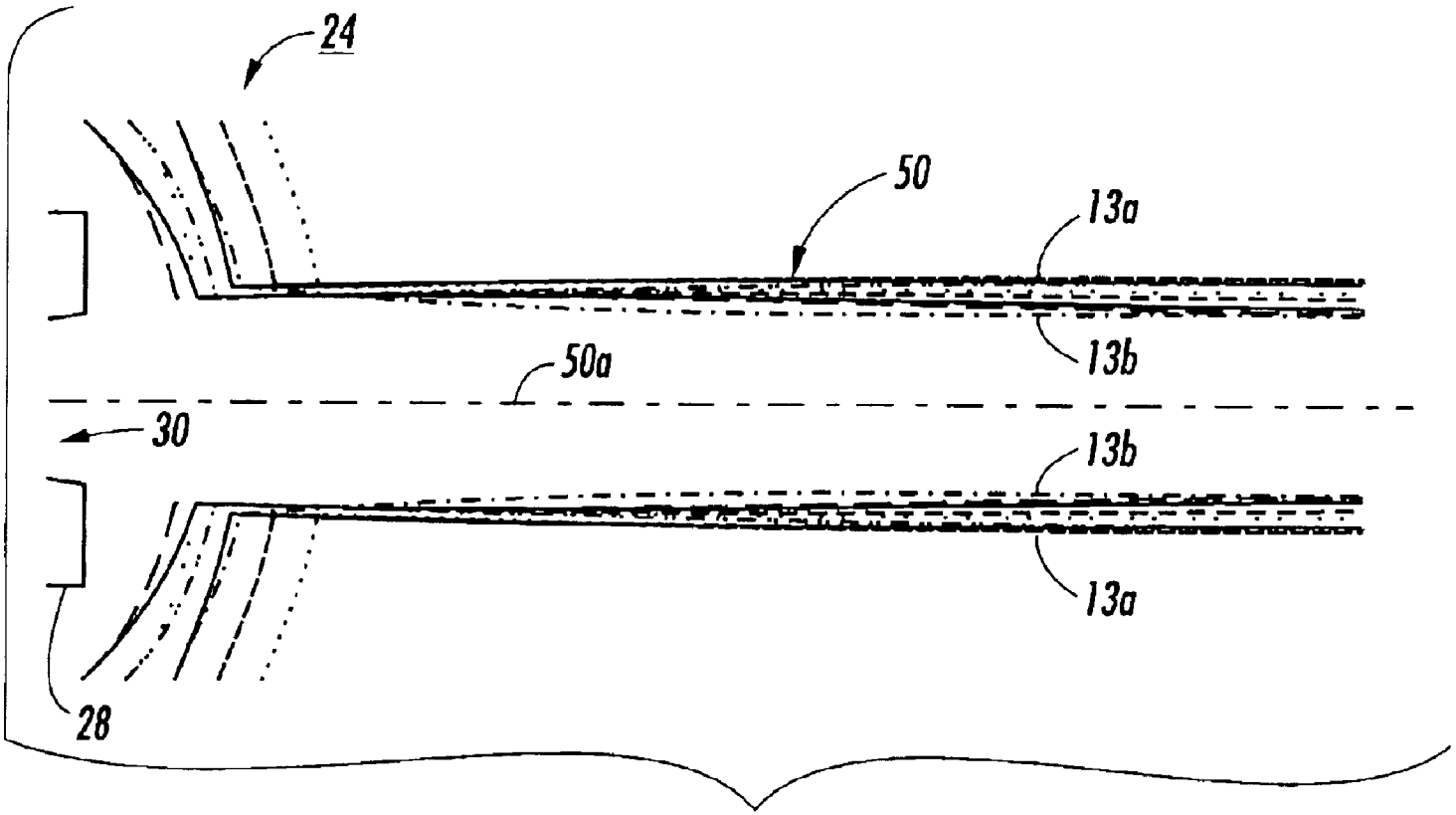
FIG. 7 (PRIOR ART)
FIG. 7 is a schematic simulation diagram of particle entrainment by the single fluid stream or jet of the conventional nozzle device of FIG. 2.

Referring now to FIGS. 2–3 and 7, a perspective schematic view, a cross-section, and a particle entrainment schematic of a conventional nozzle device 24 are shown. The conventional nozzle device 24 as shown comprises a cylindrical member 28 having a first end 31, a second 33, and a single nozzle opening 30. The nozzle opening 30 has a converging-diverging profile as shown in cross-section in FIG. 3. The converging-diverging profile nozzle opening 30 includes three basic regions, namely, a converging region 40, a narrow throat region 42, and a diverging region 44. In use or operation, a pressurized fluid or fluid that is flowing through the entire nozzle opening 30 first passes through the converging region 40, and next through the throat region 42 and then finally through the diverging region 44. From the throat region 42, the wall 46 defining the nozzle opening 30 diverges immediately at a relatively large divergent angle 48 (shown in FIG. 3). When mounted for use within a fluidized bed jet mill 10, for example, the conventional nozzle 24 will discharge a single fluid stream 50 (FIG. 7) that expands around a common nozzle stream axis 50*a*. Particle entrainment by the single fluid stream 50 of the conventional nozzle device 24 of FIG. 2 is illustrated in FIG. 7 using a schematic simulation diagram. As shown, such particle entrainment is mainly around the periphery of the jet or stream 50 with such peripherally entrained particles shown as 13*a*.

Figure 4:
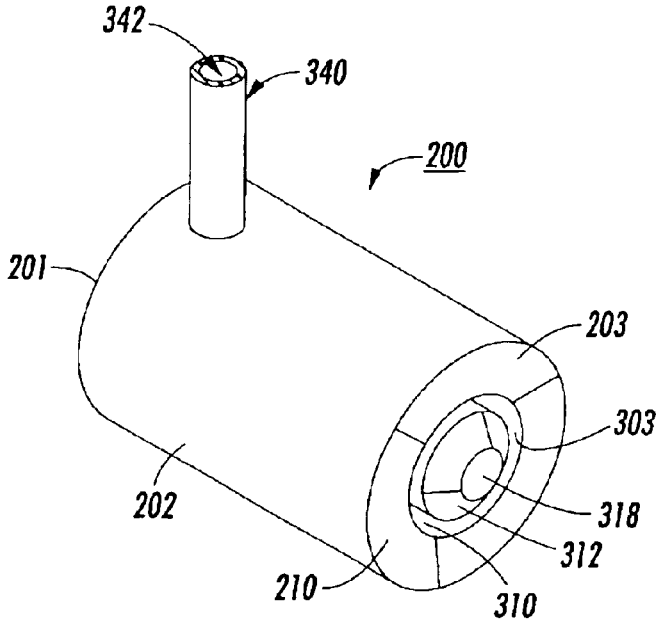
FIG. 4 is a perspective schematic of the eductor-spike nozzle device of the present disclosure.
Figure 5:
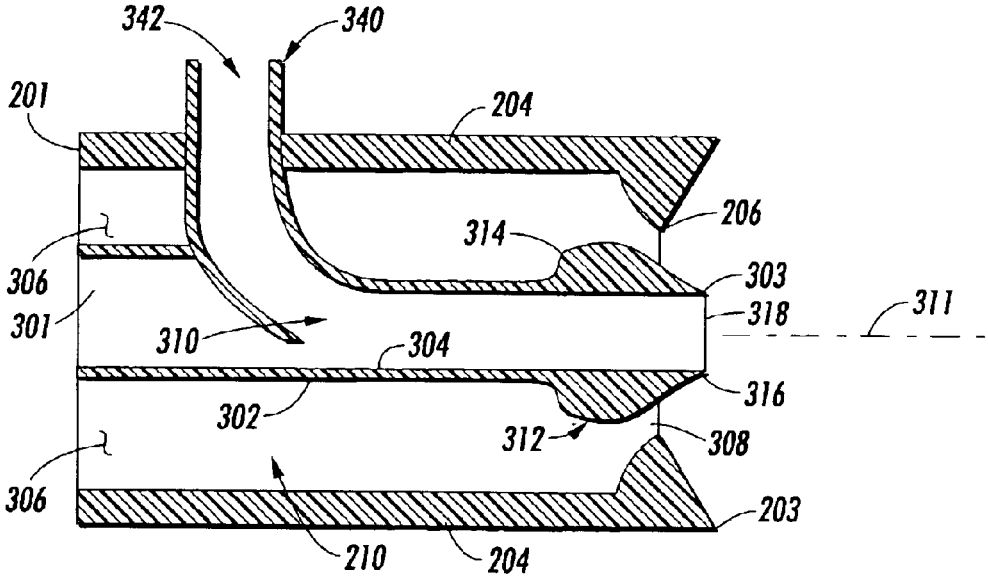
FIG. 5 is a first cross-sectional view of the eductor-spike nozzle device of FIG. 4 showing its structure.
Figure 6:
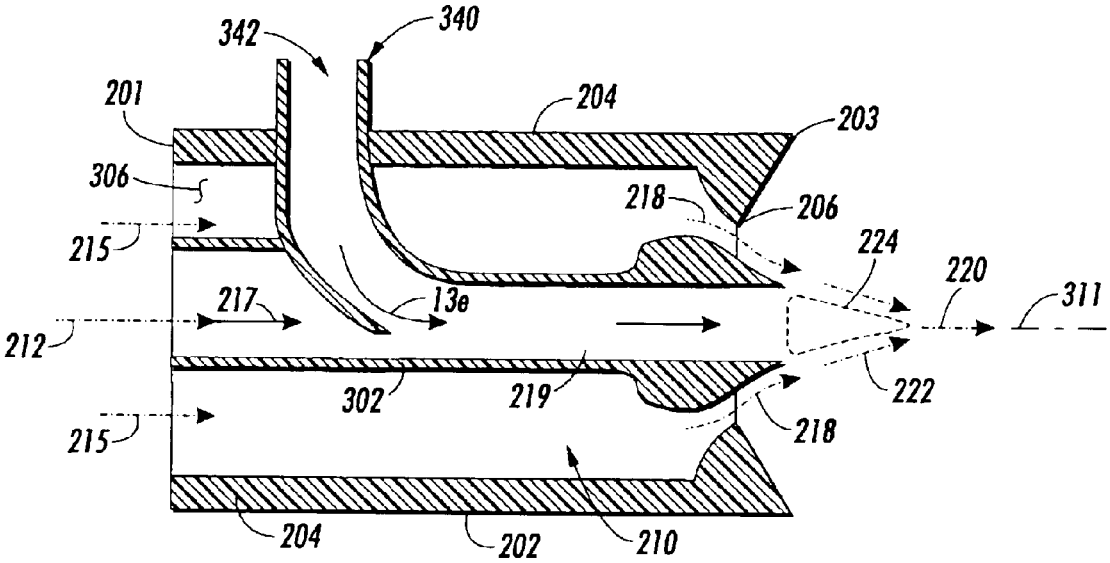
FIG. 6 is a first cross-sectional view of the eductor-spike nozzle device of FIG. 4 illustrating fluid flow.

Referring now to FIGS. 4–6, and 8, in the eductor-spike nozzle device 200 of the present disclosure, fluid flow in the form of the high velocity stream 218 discharges from the annulus or annular path 306 at some radial distance from the nozzle axis 311. Each eductor-spike nozzle device 200 as shown comprises a first cylindrical member 202 having (i) a first end 201 for receiving a first portion 215 of a low velocity stream of fluid, (ii) a second end 203 for pointing towards the central axis 18 of the grinding chamber 12 when mounted through the side walls 14, and for discharging the first portion 215 of low velocity stream as a high velocity stream or jet 218 (FIG. 6). The first cylindrical member 202 also has (iii) a first wall 204 having a cowl lip 206 towards the second end 203, and defining a first hollow interior 210 (FIG. 5) having a longitudinal axis 212.

Each eductor-spike nozzle device 200 also comprises a second cylindrical member 302 mounted within the first hollow interior 210 and having (i) a first end 301 for receiving a second portion 217 of the low velocity fluid stream (FIG. 6), (ii) a second end 303 for pointing towards the central axis 18 of the grinding chamber 12 when mounted through the side walls 14, and for discharging the second portion 217 of the low velocity fluid as a high velocity stream 219 that together with the high velocity stream 218, form the "aero-spike" 224 and the composite high velocity fluid stream 220 downstream of the second ends 203, 303.

The design of the eductor-spike nozzle device 200 is based on an advanced understanding of compressible flow, and combines the use of a central eductor or second cylindrical member 320 having the second hollow interior 310 and truncation 318 of the otherwise spike portion 312 at the second end 316 of the second cylindrical member 302.

The second cylindrical member 302 further has (iii) a second wall 304 that externally defines (a) an annular flow path 306 with the first wall 204 for flow of the first portion 215 of the low velocity fluid stream, and (b) a radially protruding and roundish portion or second end as shown in FIGS. 5 and 6 to form a flowing fluid compressing throat region 308 with the cowl lip 206 for creating an inward expansion 222 of the high velocity stream 218 towards the nozzle axis 311 downstream of the throat region 308, thereby increasing a probability of the composite high velocity stream 220 to receive and entrain particles 13 introduced thereinto downstream of the second ends 203, 303.

The second wall 304 of the second cylindrical member 302 internally defines the second hollow interior 310 that comprises an additional flow path for the second portion 217 of the low velocity fluid stream 214. The second cylindrical member 302 includes a spike portion 312 towards the second end 303 of such second cylindrical member, and the second hollow interior has a cross-sectional area that is about 52% of the cross-sectional area of the annular flow path 306. As shown in FIG. 5, the spike portion 312 has a small diameter second end 316 and a roundish relatively larger diameter first end 314. The small diameter second end 316 is truncated (FIGS. 4–6) and has a flat circular cross-sectional area 318. The small diameter second end 316 has a decreasing diameter pointed profile as shown (FIGS. 4–6) for inducing the inward expansion 222 of the high pressure high velocity fluid stream 218 towards the nozzle axis 311.

The high velocity stream 218 then expands radially and in an inward direction 222 toward the nozzle axis 311, thereby forming an "aero-spike" 224 9 to be described in detail below). The expansion process as such originates at a point on the outer edge of the annulus represented by the "cowl-lip" 206. From this point of the cowl lip 206, the high velocity stream 218 is exposed to ambient pressure, therefore the flow turning or expansion 222 of the stream 218 is limited by the influence of the external environment. Such external environment influence is believed to increase particle loading or entrainment from outside the stream into the stream 218, since such an outside or external environment to the eductor-spike nozzle device 200 (when used in a fluidized bed jet mill 10) is a particle laden environment.

Figure 8:
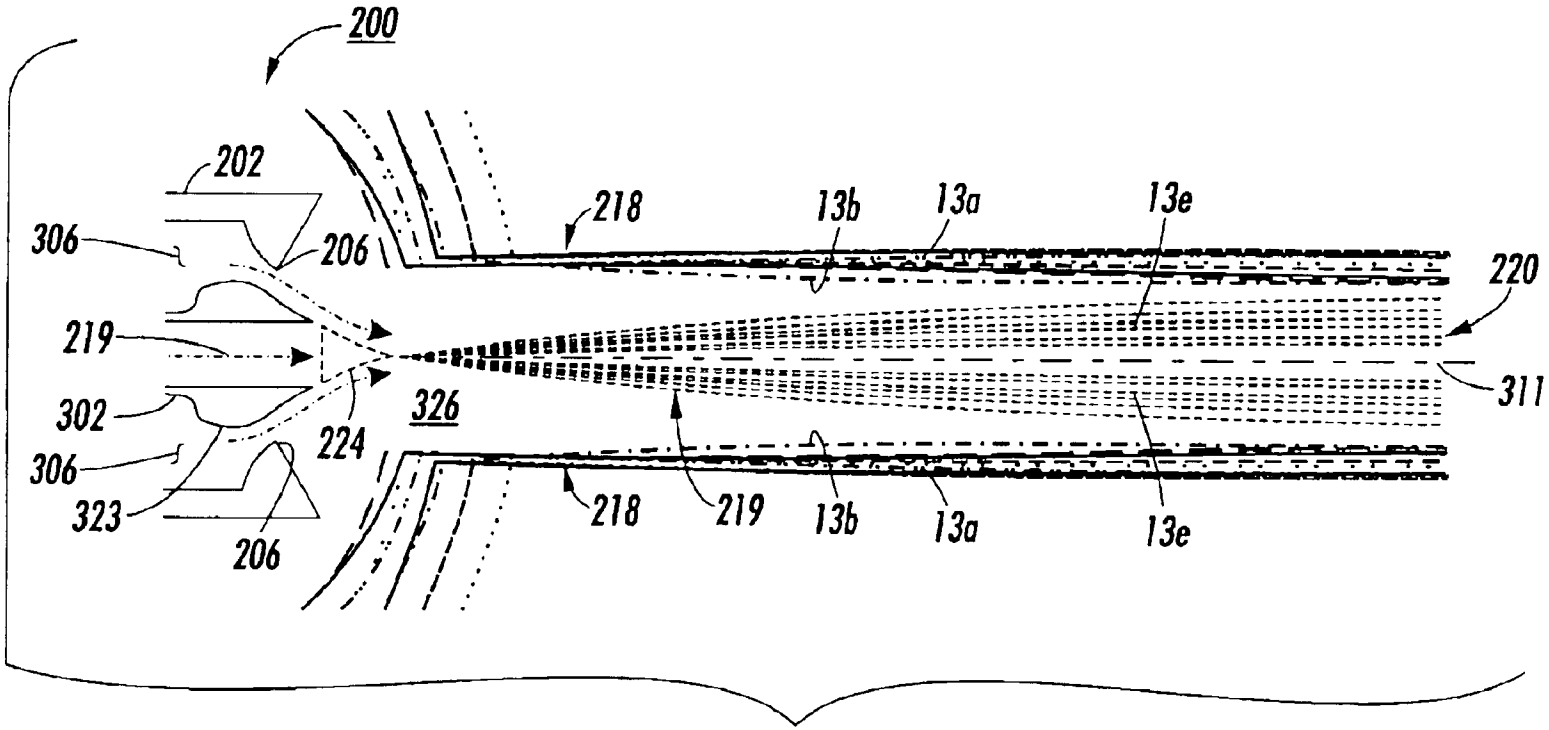
FIG. 8 is a schematic simulation diagram of particle entrainment by the fluid stream or jet of the eductor-spike nozzle device in accordance with the present disclosure.

As illustrated in FIG. 8, Computational Fluid Dynamics (CFD) simulation shows particle entrainment to include peripheral particles 13*a*, more deeply entrained particles 13*b*, and completely entrained particles 13*e* mainly coming from the eductor stream 219 laden with particles fed secondarily via conduit 340 into the inflow stream 217 (FIG. 6). FIG. 8 therefore clearly confirms the ability of eductor-spike nozzle device 200 to exceed the entrainment ability of the standard nozzle 24 while also maintaining relatively higher levels of downstream velocity and kinetic energy.

It should be noted that in a standard converging-diverging profile nozzle 24 (FIGS. 2–3 and 7), flow stream expansion is outwardly as represented by the divergence angle 48, and thus exactly the opposite of the inward expansion 222 of the eductor-spike nozzle device 200. In fact, such outwardly expansion continues regardless of what the ambient pressure is, and the flow stream can continue to over-expand until it separates from the nozzle walls.

Again one advantage of the eductor-spike nozzle device 200 is that the expansion 222 is partially defined by the ambient fluid. This allows the expansion process to compensate when the nozzle is not operated at a designed pressure ratio (i.e. at a ratio of Absolute Fluid Pressure/Absolute Ambient Pressure). Thrust loss is therefore minimal. The result is an "aero-spike" 224, as is well known in jet engine propulsion art, because of the physical truncation of what would otherwise be the decreasing diameter or pointed portion of the spike member 312 at the second end 303 of the second cylindrical member or eductor member 302 (FIG. 5). The truncated spike portion 312 has another advantage of being relatively lighter or less heavy when compared to an untruncated spike nozzle.

In operation in a fluidized bed jet mill 10 (FIG. 1), the separate low velocity fluid such as air 214 is introduced along with additional feed particles as shown in FIG. 4 into the second hollow interior 310, and is discharged as a, low velocity particle laden stream 219 and flows over the truncated decreasing diameter spike portion 312. Because of the truncation, the stream 219 is caused to recirculate and assumes a "aero-spike" contour 224 equivalent to that of a solid spike member.

In other words, in operation, a stream 217 is, for example about 1% of the total low velocity fluid 214 and is injected through the second hollow interior 310 and is discharged as the high velocity stream 219 over the truncated spike portion 312. As pointed out above, the stream 219 is caused to recirculate and forms a pattern that approximates the appropriate shape for a fully expanded nozzle flow that is desirable to produce a high velocity stream. This however allows for a full inward expansion of the fluid composite fluid 220 along the nozzle axis 311, thus maximizing the forward thrust of the stream 220. As also pointed out above, the second embodiment (FIGS. 1 and 7) also has the additional advantage of being able to dynamically compensate for changes in the operating pressure ratio.

This present disclosure thus utilizes a combination of a spike nozzle design, material eduction, and the aero-spike concept for entraining and ejecting particles of material via a central eductor 310 in the eductor-spike nozzle device 200. This eduction system (nozzle device 200) increases the loading of particles of material into the composite high velocity stream 220, thus greatly increasing the probability of particle to particle collisions. The system therefore also ensures that maximum kinetic energy is realized at the collision plane. The overall effect is an increase in the grinding efficiency and throughput rate of the fluidized bed jet mill 10 (FIG. 1).

As also shown, each eductor-spike nozzle device 200 further includes the secondary material feeding conduit 340 including a feed path 342 for feeding particles 13*e* of material into the second hollow interior 310 of the eductor member or second cylindrical member 320. The particles 13*e* are fed such that they are blown forwardly by the second inflow stream 217 (FIG. 6) for eduction in the particle laden high velocity stream 219 at the second end 303.

Figure 9:
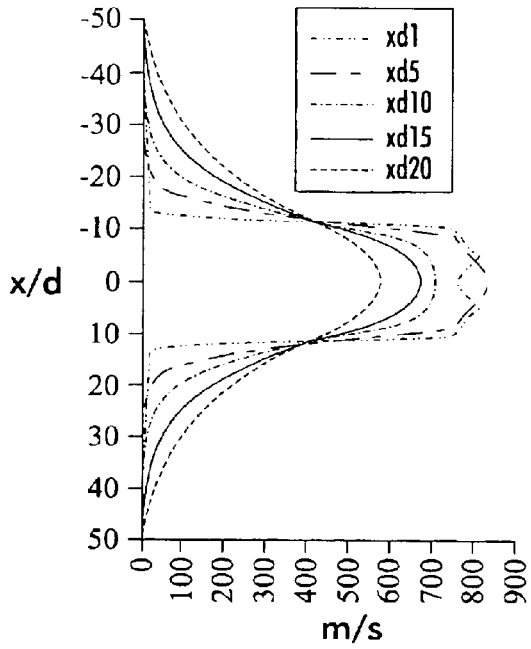
FIG. 9 (PRIOR ART)
FIG. 9 is a graphical illustration of a plot of velocity profiles of the converging-diverging profile nozzle opening in the conventional nozzle device of FIG. 2, at non-dimension distances of 1, 5, 10, 15, and 20 throat diameters from the nozzle exit.
Figure 10:
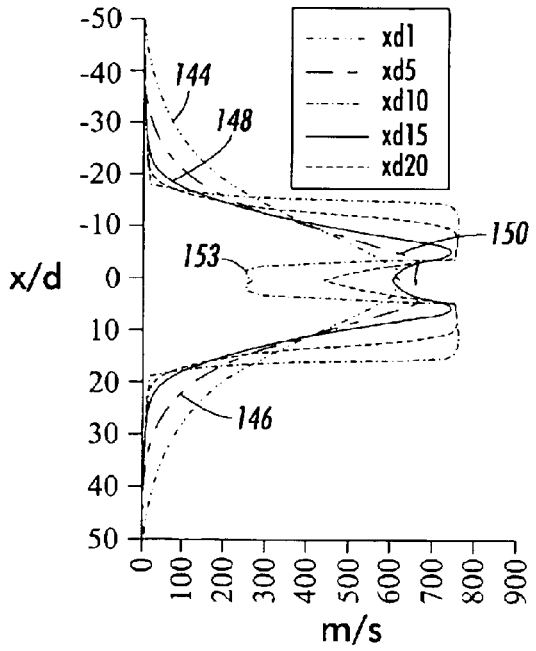
FIG. 10 is a graphical illustration of a plot of velocity profiles, of a composite stream from the eductor-spike nozzle device in accordance with the present disclosure.

Referring now to FIGS. 8–10, simulations using computational fluid dynamics (CFD) were performed to compare the performance of the standard nozzle device 24 (FIGS. 2–3) to that of the spike-eductor nozzle device 200. Since the CFD simulation satisfies the conservation of mass, momentum, and energy over the descretized fluid domain with appropriate boundary conditions, the CFD results are believed to be representative of "real-world" performance.

As a basis for the comparison of nozzle performance, the nozzles were initially compared using several numerical metrics, such as input pressure, output pressure, exit diameter, thrust, average velocity at the exit end and at a non-dimensional distance of x/d=20 from the exit end. The results of the comparison show clearly that for equal mass flux, the eductor-spike nozzle device 200 results in a relatively higher thrust and average velocity at the nozzle device discharge end 203, 303 than the conventional flared opening nozzle device 24.

Referring next to FIGS. 9 and 10 a comparison of the nozzles can be seen in the examination of velocity profile plots across the nozzle diameter of each nozzle opening, and at different non-dimensional distances from the exit end, e.g. end 203, 303 of eductor-spike nozzle device 200. FIGS. 9–10 show such velocity profiles at non-dimension distances of 1, 5, 10, 15, and 20 from such exit end for each nozzle. The non-dimensional distance is a multiple of "equivalent throat diameter" for each nozzle device. The "equivalent throat diameter" for a nozzle device is defined as the diameter which yields equivalent total surface area for all nozzle openings.

In general, FIGS. 9–10 show the velocity profiles of the jet emanating from the nozzle device as a function of distance from the nozzle discharge end, for example, end 203, 303. The velocity profiles are determined using CFD (Computational Fluid Dynamics) simulation. The x-axis is the velocity towards the center of the chamber and is given in meters/second. The y-axis is the lateral distance (in mm) from the longitudinal axis 104, 311. Each line series shows a jet velocity profile at a non-dimensional interval 'x/d' from the nozzle, where 'x' is the distance from the nozzle discharge end 203, 303 and 'd' is the equivalent throat diameter of the nozzle device. The "equivalent throat diameter" of a device is defined as the opening diameter which yields equivalent surface area as the sum of surface area for all openings. The general trend is for the core of the jet to decrease in velocity at greater distances from the nozzle as the jet mixes with the surrounding fluid, entraining and accelerating particles for communition.

Specifically FIG. 9 shows velocity profiles for the conventional nozzle device 24 (FIGS. 2–3) having a single flared profile opening. These velocity profiles are taken across the nozzle longitudinal axis 104, 311 as the jet progresses downstream from the discharge end 33 of the nozzle. At X/D=1 the jet has an extreme velocity gradient to the surrounding fluid at about 12 mm lateral distance from the longitudinal axis 104, 311. As the jet passes downstream through X/D=5, 10, 15, and 20 there is more mixing of the jet with the surrounding fluid as both air and particles are entrained into the flow, the maximum velocity of the jet decreases and the jet tends to broaden. Relative to the invention, the particles can only be entrained along the periphery of the jet and do not mix into the center.

Similarly, the velocity profiles in FIG. 10 are shown as a function of lateral distance from the longitudinal axis 104, 311. An immediate observation as seen in element 144–150 is the broader jet dimension, which translates into greater circumferential area for particle entrainment. Element 153 shows that the initial velocity pocket at X/D=1 extends down to about 275 m/s and that the velocity has longer downstream persistence than comparable locations of FIG. 9. The larger velocity pocket results in higher entrainment opportunity for the eductor-spike nozzle design. Comparison of particle entrainment confirms the superior entrainment ability of the eductor-spike nozzle design over the conventional nozzle profiles shown in FIGS. 2–3.

Lastly, it can be seen that even though the entrainment ability of the eductor-spike design has been increased, the maximum downstream velocity at X/D=20 is about the same. This feature assures that there is sufficient particle momentum for breakage at the higher entrainment level. Higher downstream momentum for the eductor-spike design is a direct result of the non-linear contour design previously described, wherein fully expanded parallel exit flow results in equivalent or higher downstream momentum even at increased entrainment levels.

Comparing the velocity profile (FIG. 9) of the conventional nozzle 24 with that (FIG. 10) of the eductor-spike nozzle device 200, it can be seen that a low velocity region or "pocket" 153 is exhibited in the proximity of the exit area or end 203, 303 of the eductor-spike nozzle where the non-dimensional distance (x/d) is less than 10. This low velocity region or pocket 153 does operate to allow more particles (than in the case of the first type 24) to move towards the axis of the nozzle member, and thus increase their probability of being entrained within the center 220*a* of the composite jet 220, thus increasing the jet loading.

Particle tracking simulations were also done for similar comparisons. A particle density of 1200 kg/m^3 was used. Each particle group consisted of 5 diameter sizes: 10, 32.5, 55, 77.5, and 200 micron. The particle groups were released at 5, 10, 15, and 20 microns axial distance from the plane of the exit face of the nozzle. All release points were 30 mm away from the axis to show the entrainment of the particles into the jet stream. The particle tracking results are shown in FIGS. 8–10, and show that particles injected via the central eductor 310 are easily entrained into the jet 220, thus increasing the carrying capacity of such jet. Such a relatively higher jet loading thereby increases the probability of particle-to-particle collisions.

As can be seen, there has been provided an eductor-spike nozzle device for mounting through side walls of a fluidized bed jet mill to discharge a composite stream of high velocity fluid for receiving, entraining and delivering particles of material into a grinding chamber of a fluidized bed jet mill for particle to particle collisions. The eductor-spike nozzle device includes (a) a first cylindrical member having a first wall including a cowl lip and defining a first hollow interior, and (b) a second cylindrical member mounted within the first hollow interior and having a second wall (i) externally defining an annular flow path with the first wall for flow of a first stream of fluid, and fluid compressing throat region with the cowl lip for creating a high velocity stream, and (ii) internally defining a second hollow interior for flow of a second stream of fluid so as to form the composite stream of high velocity fluid with the first stream of fluid, thereby increasing a probability of the composite stream receiving and entraining particles introduced into the composite stream.

While the present invention has been described in connection with a preferred embodiment thereof, it is understood that it is not intended to limit the invention to this embodiment. On the contrary, it is intended to cover all alternatives, modifications, and equivalents as may be included within the spirit and scope of the invention as defined by the appended claims:

What is claimed is:

1. An eductor-spike nozzle device for mounting through side walls of a fluidized bed jet mill to discharge a composite stream of high velocity fluid for receiving, entraining and delivering particles of material into a grinding chamber of a fluidized bed jet mill for particle to particle collisions, the eductor-spike nozzle device comprising:

(a) a first cylindrical member having a first wall, said first wall including a cowl lip and defining a first hollow interior, and (b) a second cylindrical member mounted within said first hollow interior and having a second wall, said second wall (i) externally defining an annular flow path with said first wall for flow of a first stream of fluid, and said second wall including a radially protruding and roundish portion defining a fluid compressing throat region with said cowl lip, said second cylindrical member having a small diameter second end and a roundish relatively larger diameter first ends for accelerating said first low velocity stream of fluid into a first high velocity stream of fluid, and (ii) said second wall internally defining a second hollow interior for flow of a second stream of fluid for forming the composite stream of high velocity fluid with said first high velocity stream of fluid, thereby increasing a probability of the composite stream of high velocity fluid receiving and entraining the particles of material introduced into the composite stream of high velocity fluid.

2. An eductor-spike nozzle device for mounting through side walls of a fluidized bed jet mill to discharge a stream of high velocity fluid for receiving, entraining and delivering particles of material into a grinding chamber of the fluidized bed jet mill for particle to particle collisions, the eductor-spike nozzle device comprising:

(a) a first cylindrical member having (i) a first end for receiving a first low velocity stream of fluid, (ii) a second end for pointing towards a central axis of the grinding chamber when mounted through said side walls, and for discharging said first low velocity stream of fluid as a first high velocity stream of fluid, and (iii) a first wall having a cowl lip at said second end, said cowl lip having a small diameter second end and a roundish relatively larger diameter first end, and said first wall defining a first hollow interior; and (b) a second cylindrical member mounted within said first hollow interior and having a second wall including a radially protruding and roundish portion defining (i) an annular flow path for said first low velocity stream of fluid and for said first high velocity stream of fluid, (ii)

a throat region with said cowl lip for accelerating said first low velocity stream of fluid into said first high velocity stream, and (iii) said second wall defining a second hollow interior for receiving and discharging a second low velocity stream of fluid.

3. The eductor-spike nozzle device of claim 2, wherein said second hollow interior has a cross-sectional area that is between 40% and 60%, and preferably between 50% and 55%, of a cross-sectional area of said annular flow path.

4. The eductor-spike nozzle device of claim 2, including an input conduit, for particles of material, connected to and communicating with said second hollow interior for introducing particles of into the second low velocity stream of fluid.

5. The eductor-spike nozzle device of claim 2, wherein said first high velocity stream of fluid upon discharge expands inwardly onto, and engulfs said second low velocity stream of fluid.

6. The eductor-spike nozzle device of claim 2, wherein said second wall of said second cylindrical member includes a downstream decreasing diameter portion for inducing an inward expansion of said first high velocity stream of fluid.

7. The eductor spike nozzle device of claim 6, wherein said decreasing diameter portion includes a truncated end resulting in first high velocity stream of fluid and said second low velocity fluid forming an aero-spike substantially equivalent in profile to that of a non-truncated spike profile.

8. A fluidized bed jet mill for grinding particles of material comprising:

(a) a base, a top and side walls defining a grinding chamber having a central axis; and (b) plural eductor-spike nozzle devices mounted through said side walls into said grinding chamber to each discharge a stream of high velocity fluid for receiving, entraining and delivering, for particle to particle collisions, particles of material to be ground within said grinding chamber, said each eductor-spike nozzle device including:

(i) a first cylindrical member having (i) a first end for receiving a first low velocity stream of fluid, (ii) a second end for pointing towards a central axis of the grinding chamber when mounted through said side walls, and for discharging said first low velocity stream of fluid as a first high velocity stream of fluid, and (iii) a first wall having a cowl lip at said second end, said cowl lip having a small diameter second end and a roundish relatively larger diameter first end, and said first wall defining a first hollow interior; and (ii) a second cylindrical member mounted within said first hollow interior and having a second wall including a radially protruding and roundish portion defining (i) an annular flow path for said first low velocity stream of fluid and for said first high velocity stream of fluid, (ii) a throat region with said cowl lip for accelerating said first low velocity stream of fluid into said first high velocity stream, and (iii) said second wall defining a second hollow interior for receiving and discharging a second low velocity stream of fluid.

9. The fluidized bed jet mill of claim 8, wherein said second hollow interior has a cross-sectional area that is between 40% and 60%, preferably between 50% and 55%, of a cross-sectional area of said annular flow path.

10. The fluidized bed jet mill of claim 8, including an input conduit, for particles of material, connected to and communicating with said second hollow interior for introducing particles of into the second low velocity stream of fluid.

11. The fluidized bed jet mill of claim 8, wherein said first high velocity stream of fluid upon discharge expands inwardly onto, and engulfs said second low velocity stream of fluid.

12. The fluidized bed jet mill of claim 8, wherein said second wall of said second cylindrical member includes a downstream decreasing diameter portion for inducing an inward expansion of said first high velocity stream of fluid.

13. The eductor spike nozzle device of claim 12, wherein said decreasing diameter portion includes a truncated end resulting in first high velocity stream of fluid and said second low velocity fluid forming an aero-spike substantially equivalent in profile to that of a non-truncated spike profile.

* * * * *